US005512708A

United States Patent [19]

Takahashi et al.

[11] Patent Number: 5,512,708

[45] Date of Patent: Apr. 30, 1996

[54] TONER USED IN AN IMAGE FORMING APPARATUS

[75] Inventors: Sadao Takahashi, Tokyo; Kouichi Yamazaki, Yokohama; Nobuo Kikuchi, Kawagoe; Kentaro Matsumoto, Ichikawa; Tadashi Hayakawa, Tokyo; Yoshiaki Miyashita, Kawasaki; Takeshi Tabuchi, Kawaguchi, all of Japan

[73] Assignee: Ricoh Company, Ltd., Tokyo, Japan

[21] Appl. No.: 323,803

[22] Filed: Oct. 17, 1994

[30] Foreign Application Priority Data

Oct. 20, 1993 [JP] Japan ..... 5-262331

[51] Int. Cl.[6] ..... G03G 15/08

[52] U.S. Cl. ..... 118/653; 430/105; 430/109; 430/111

[58] Field of Search ..... 355/219, 245; 118/653; 430/105, 107, 109, 110, 111

[56] References Cited

U.S. PATENT DOCUMENTS 5,305,061 4/1994 Takama et al. ..... 355/219

5,415,965 5/1995 Tsuda et al. ..... 430/109

FOREIGN PATENT DOCUMENTS 62-269150 11/1987 Japan .

*Primary Examiner*—William J. Royer

*Attorney, Agent, or Firm*—Oblon, Spivak, McClelland, Maier & Neustadt

[57] ABSTRACT

An image forming apparatus includes a photosensitive body. A charge member is held in contact with the photosensitive body and charges the photosensitive body by applying a voltage thereto. An exposure device exposes a surface of the photosensitive body charged by the charge member and forms an electrostatic latent image. A developing device attaches toner to the electrostatic latent image on the photosensitive body and visualizes the electrostatic latent image. Further, a particle diameter of fine powder which is the toner used in the developing device is equal to or less than 3 μm, and a containing rate of the fine powder is equal to or less than 5%. Further, an angle of spatula of the toner used in the developing device may be at least 25 degrees. A cohesiveness of the toner may also be at least 9%.

4 Claims, 1 Drawing Sheet

TONER USED IN AN IMAGE FORMING APPARATUS

BACKGROUND OF THE INVENTION

1. Field of the Invention

The present invention is directed to an image forming apparatus, such as a copier or printer, in which an electrophotographic method is employed for a contact-charging in which a charge member has a voltage applied thereto and is held in contact with a photosensitive body and a surface of the photosensitive body is charged. More particularly, the present invention is directed to a toner used in a developing device of the image forming apparatus.

2. Discussion of the Background

In a conventional image forming apparatus utilizing an electrophotographic method represented by a Carlson process, there is a non-contact-charging method in which the surface of the photosensitive body is uniformly charged. A high voltage is applied to a tungsten wire (30–100 μm) called a corona wire. Corona discharge is performed between the corona wire and the photosensitive body. The surface of the photosensitive body is charged. As a result, air is ionized and a great amount of ozone and nitric oxide are generated.

Ozone and nitric oxide are harmful to the human body and aggravate deterioration of the photosensitive body as well as mechanical elements. While negative discharge is performed, ozone is generated in a very great amount. Recently, the photosensitive body became an organic photosensitive body for negative discharge. Environmental standards for gas exhausted from the image forming apparatus may also now be restricted, which causes serious problems.

As compared with the non-contact-charging method, there is a contact-charging method in which a charge member is held in contact with the photosensitive body and the surface of the photosensitive body is charged. In this operation a voltage applied to the charge member is low. A very small amount of ozone is then generated. These are advantages of the contact-charging method. An image forming apparatus provided with a roller-shaped contact charge member has been on the market.

However, in respect of uniformity of charge distribution, the contact-charging method is inferior to the non-contact-charging method with the corona wire.

Japanese Patent Laid-Open Publications No. 1249668/1988 teaches that the uniformity of charge distribution can be noticeably improved. This reference discloses that an AC voltage having a peak-to-peak voltage more than twice as high as a charge start voltage is superposed to the contact charge member in the event of application of a DC voltage.

However, there are the following problems in the above mentioned scheme. First, a size of a power source for applying the voltage increases. Also, a high frequency sound is generated by application of the AC voltage. Further, as the voltage is not efficiently used, an amount of ozone generation increases. Also, with application of the AC voltage, the material of the charge member is not apt to be restricted. There also arises a problem to be solved in that toner is easily fused to the charge member by a vibration electric field.

The uniformity of charge distribution performed with application of only the DC voltage without the AC voltage is studied. However, the material of the charge member is apt to be restricted. Even though material of good uniformity could be found, toner and paper dust attach to the charge member. Because the charge member is constantly held in contact with the photosensitive body, variation of an electric resistance value occurs partially, and this results in non-uniformity of charge distribution.

It has been suggested that the charge member be provided with a cleaning member so as to clean a surface of the charge member. Japanese Patent Laid-Open Publication No. 101768/1991 teaches that a sponge material (polyurethane foam, polyethylene foam) is held in contact with the surface of the charge member and cleans the surface.

However, the surface of the charge member is made of resin or rubber in general. As a result, it is difficult to remove toner attached to the surface of the charge roller. If the cleaning member is held in contact with the surface of the charge member with high pressure, toner can be removed, but the surface of the charge member is easily scratched. If the cleaning member is held in contact with the surface of the charge member with low pressure so as not to scratch the surface of the charge member, toner remains in the surface as an undesirable lateral strip. There then arises a problem to be solved that adjustment for contact pressure to the surface of the charge member is difficult.

SUMMARY OF THE INVENTION

Accordingly, one object of the present invention is to provide a novel image forming apparatus in which a charge member cannot easily be contaminated with toner by specifying a property value of toner used in a developing device.

It is another object of the present invention to provide an image forming apparatus in which uniformity of charge distribution can be improved.

It is another object of the present invention to provide an image forming apparatus capable of reducing an undesirable lateral strip on a surface of a charge member.

In order to achieve the above-mentioned objects, according to the present invention, there is provided an image forming apparatus including a photosensitive body, a charge member held in contact with the photosensitive body and for charging the photosensitive body by applying a voltage thereto, an exposure device for exposing a surface of the photosensitive body charged by the charge member and for forming an electrostatic latent image on the photosensitive body, and a developing device for attaching toner to the electrostatic latent image on the photosensitive body and for visualizing the electrostatic latent image, wherein a particle diameter of fine powder which is the toner used in the developing device is equal or less than 3 μm and a containing rate of the fine powder is equal to or less than 5%.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein.

DESCRIPTION OF THE PREFERRED EMBODIMENTS

A preferred embodiment of an image forming apparatus in accordance with the present invention is explained herein with reference to the accompanying drawings.

Figure 1:
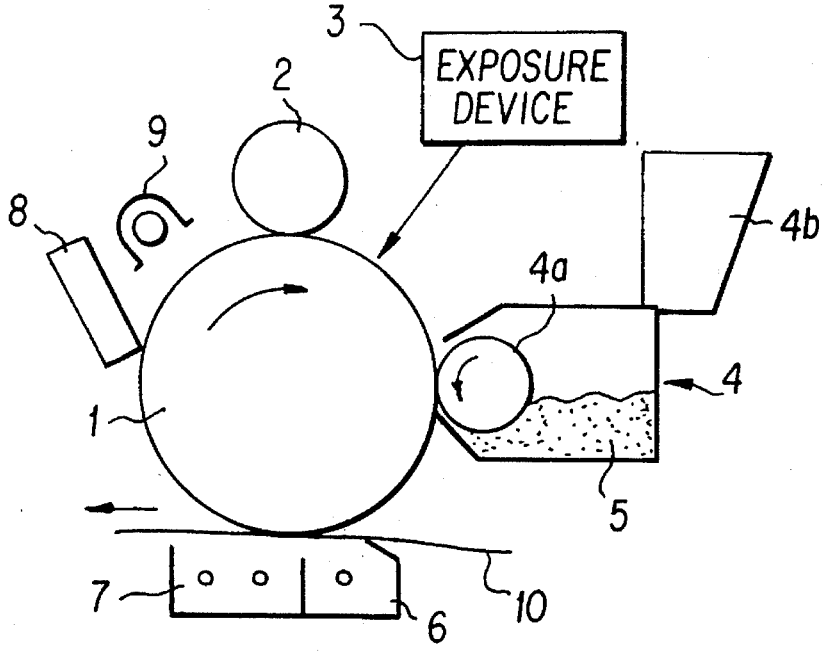
FIG. 1 is a section showing an image forming apparatus in accordance with the present invention.

FIG. 1 is a section showing an image forming apparatus in accordance with the present invention.

Referring to FIG. 1, a charge roller 2 as a contact charge member, an exposure device 3, a separating charger 7, a cleaning member 8, and a charge removing lamp 9 are disposed around a photosensitive drum 1 rotated in the direction indicated by the arrow.

A developing device 4 is provided with a developing roller 4*a*, and an attachable/removable toner cartridge 4*b*. Toner 5 supplied from the toner cartridge 4*b* is agitated with an agitator (not shown). Toner 5 becomes attached to an outer surface of the developing roller 4*a* and is then transferred to a surface of the photosensitive drum 1. The exposure device 3 includes a device for optically scanning documents, a device for modulating and radiating a laser beam on the photosensitive drum 1 in accordance with an image data, and a device using a LED (Light Emitting Device).

The image forming apparatus performs image forming in a contact-charging electrophotographic method by the above mentioned devices. A voltage is applied to the charge roller 2. A discharge is initiated at a very small gap between the photosensitive drum 1 and the charge roller 2. The surface of the photosensitive drum 1 is charged at an optional voltage in accordance with both applying a voltage value to the charge roller 2 and a thickness of a photosensitive layer. By the rotation of the photosensitive drum 1 in the direction indicated by the arrow, the charged surface of the photosensitive drum 1 is exposed by the exposure device 3 in accordance with a brightness/darkness of the image to be formed. An electrostatic latent image is thereby formed on the surface of the photosensitive drum 1.

When the electrostatic latent image passes through the developing device 4 by the rotation of the photosensitive drum 1, toner 5 is attached to the photosensitive drum 1 by the developing roller 4*a* rotating in the direction indicated by the arrow so as to visualize the electrostatic latent image. The visualized image (toner image) on the photosensitive drum 1 is transferred to a transferring paper 10 by the transferring charger 6. The transferring paper 10 is fed and delivered between the transferring charger 6 and the photosensitive drum 1 by a paper feeding device (not shown). The transferring paper 10 is separated from the photosensitive drum 1 by the separating charger 7 and is delivered to a fixing device (not shown). The toner image transferred to the transferring paper 10 is thereby fixed. The transferring paper 10 is then delivered outside the image forming apparatus.

Residual toner on the photosensitive drum 1 is then removed by the cleaning member 8. A charge removing light is then radiated to the surface of the photosensitive drum 1 by the charge removing lamp 9 so that the charge of the photosensitive drum 1 is removed (zero voltage). A next image forming operation is then prepared. The image forming operation per one page is then performed by repeating the cycle of this operation.

After repeating the image forming operation, the charge roller 2 as the contact charge member is gradually covered with toner. It is found that this phenomenon is closely related with the property value of the toner. When the charge roller 2 is covered with toner, the electric resistance value on the surface of the charge roller 2 is varied, and a surface voltage on the photosensitive drum 1 is varied by a variation of discharging amount. An undesirable lateral strip then appears on the image.

The property value of toner used in the present invention will be explained hereinafter.

An experiment was conducted on the image forming apparatus of FIG. 1 under the following conditions:

Photosensitive drum: OPC (Organic Photo Conductive)

Line Speed of Photosensitive Drum: 120 mm/sec

Charge Roller: Elastic member with moderate electric conductivity

Charge applying voltage: −1500 V

Number of delivered paper: 60000

Size of delivered paper: A4

Developing method: Dry-type two-component developer

Cleaning method: Counter blade

In following Tables 1–5, there is a column for the undesirable lateral strip.

'0' indicates that no lateral strip exists;

'Δ' indicates that a slight lateral strip exists;

'Δ*' indicates that an extremely slight lateral strip exists;

'X' indicates that many lateral strips exist;

'–' indicates that the image cannot be formed.

In Table 1 below, the relationship between a containing rate of a fine powder which is toner used in the invention and a contamination of the charge member (toner contamination) is shown.

Referring to Table 1, if the containing rate of a fine powder is more than 5%, an undesirable lateral strip appears on the image in accordance with the number of delivered paper. Particle diameter of the fine powder is equal to or less than 3 μm. The charge member (charge roller 2) is covered with toner. As the electric resistance value of the charge member is increased, a surface voltage of the photosensitive drums is reduced.

When the surface of the charge roller 2 is observed with a 500~1000 times optical microscope, the particle diameter of the fine powder on the surface is almost 1~3 μm. If the containing rate of the fine powder is equal to or less than 5%, the contamination of the charge roller 2 does not cause any problems. If the containing rate of the fine powder is equal to or less than 5%, a decline in the surface voltage of the photosensitive drum 1 does not cause any problems. If the containing rate of the fine powder is equal to or less than 3%, the contamination of the charge roller 2 and the decline in the surface voltage of the photosensitive drum 1 is further prevented.

TABLE 1

| Containing rate | No. of delivered paper | 0 | 10000 | 20000 | 30000 | 40000 | 50000 | 60000 |
|---|---|---|---|---|---|---|---|---|
| 11% | Lateral strip | 0 | 0 | X | X | — | — | — |
| | Surface Voltage (v) | −900 | −890 | −850 | −830 | — | — | — |
| 9 | Lateral strip | 0 | 0 | 0 | Δ | X | X | X |
| | Surface Voltage (v) | −900 | −900 | −890 | −870 | −850 | −850 | −830 |

TABLE 1-continued

| Containing rate | No. of delivered paper | 0 | 10000 | 20000 | 30000 | 40000 | 50000 | 60000 |
|---|---|---|---|---|---|---|---|---|
| 7 | Lateral strip | 0 | 0 | 0 | 0 | Δ | Δ | X |
| | Surface Voltage (v) | −900 | −900 | −900 | −890 | −870 | −860 | −850 |
| 5 | Lateral strip | 0 | 0 | 0 | 0 | 0 | 0 | Δ* |
| | Surface Voltage (v) | −900 | −900 | −900 | −900 | −900 | −890 | −890 |
| 3 | Lateral strip | 0 | 0 | 0 | 0 | 0 | 0 | 0 |
| | Surface Voltage (v) | −900 | −900 | −900 | −900 | −900 | −895 | −895 |

In Table 2, a variation on the surface voltage of the photosensitive drum 1 and a presence/absence of the undesirable lateral strip on the image with respect to the number of delivered paper are shown in a case that toner with the same volume average particle diameter is used, which is manufactured by a mechanical crushing method and a polymerization method. In the mechanical crushing method, a toner product is manufactured from raw material by the following procedure: raw material→mixture→mechanical crushing→classifying→adding→filling→toner product.

In the polymerization method, there exists emulsion polymerization, suspension polymerization, soap free polymerization, seed polymerization, and dispersion polymerization as manufacturing methods. Toner used in the present invention can be manufactured by one of the above mentioned methods. Volume average particle diameter used in the experiment is 9 μm.

Referring to Table 2, if toner manufactured by the polymerization method is used in the experiment, the undesirable lateral strip does not appear on the image. If toner manufactured by the polymerization method is used in the experiment, the variation in the surface voltage of the photosensitive drum 1 does not cause any problems.

There is a difference in distribution of particle diameter between toner manufactured by the mechanical crushing method and toner manufactured by the polymerization method. Distribution of particle diameter in toner manufactured by the polymerization method is narrower than that of toner manufactured by the mechanical crushing method.

TABLE 2

| Method | No. of delivered paper | 0 | 10000 | 20000 | 30000 | 40000 | 50000 | 60000 |
|---|---|---|---|---|---|---|---|---|
| Mechanical crushing method | Lateral strip | 0 | 0 | 0 | Δ | X | X | X |
| | Surface Voltage (v) | −900 | −900 | −890 | −880 | −850 | −850 | −830 |
| Polymerization method | Lateral strip | 0 | 0 | 0 | 0 | 0 | 0 | 0 |
| | Surface Voltage (v) | −900 | −900 | −900 | −900 | −900 | −895 | −895 |

In Table 3, results of cohesiveness of toner with respect to the number of delivered paper measured by the following procedure of, variation in the surface voltage of the photosensitive drum 1 and presence/absence of the undesirable lateral strip on the image, are shown. The measuring procedure for cohesiveness of toner includes the following steps (1)–(4):

(1) three sieves with a different mesh are piled such that a mesh size becomes finer from upper stage to lower stage; (2) three sieves are disposed on a vibrating stand, toner measured with a balance is placed on an upper surface of the upper sieve; (3) three sieves are vibrated in a constant period, fine powder remaining on each sieve is measured with the balance; and (4) cohesiveness of toner is calculated in the following formula, cohesiveness of toner=(B1/A)×C1×100%+(B2/A)×C2×100%+(B3/A)×C3×100%; wherein C1 =1, C2=⅗, C3=⅕; A is total weight of fine powder at the time of initiation; B1, B2, B3 are weights of fine powder remaining on each sieve; and C1, C2, C3 are weight coefficients.

Referring to Table 3, if cohesiveness of toner is less than 6%, the undesirable lateral strip on the image and the variation in the surface voltage of the photosensitive drum 1 are not satisfactory results.

TABLE 3

| Cohesiveness | No. of delivered paper | 0 | 10000 | 20000 | 30000 | 40000 | 50000 | 60000 |
|---|---|---|---|---|---|---|---|---|
| 3% | Lateral strip | 0 | Δ | Δ | X | X | — | — |
| | Surface voltage (v) | −900 | −880 | −870 | −850 | −830 | — | — |
| 6% | Lateral strip | 0 | 0 | 0 | 0 | 0 | 0 | Δ |
| | Surface Voltage (v) | −900 | −900 | −900 | −900 | −890 | −880 | −870 |
| 9% | Lateral strip | 0 | 0 | 0 | 0 | 0 | 0 | 0 |

TABLE 3-continued

| Cohesiveness | No. of delivered paper | 0 | 10000 | 20000 | 30000 | 40000 | 50000 | 60000 |
|---|---|---|---|---|---|---|---|---|
| | Surface Voltage (v) | −900 | −900 | −900 | −900 | −900 | −890 | −890 |

Figure 2:
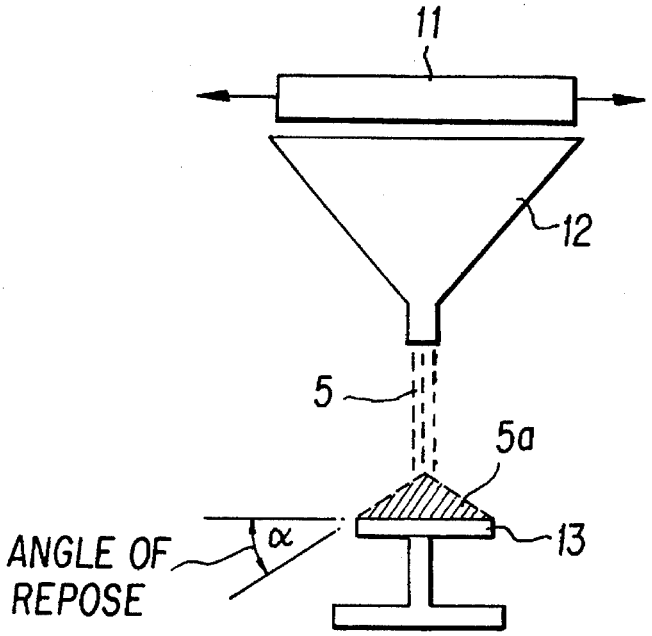
FIG. 2 is a section showing a method for measuring an angle of repose of toner.

In Table 4, results of an angle of repose of toner with respect to the number of delivered paper measured by the following procedure of, variation in the surface voltage of the photosensitive drum 1 and presence/absence of the undesirable lateral strip on the image, are shown. The measuring procedure for the angle of repose includes the following steps (1)–(4):

(1) as shown in FIG. 2, a standard sieve 11, a funnel 12, and a circular plate 13 are disposed in this order from top; (2) the standard sieve 11 supplied with toner 5 is vibrated in constant force; (3) toner 5*a* fallen from the standard sieve 11 is piled up like a cone on the circular plate 13 through the funnel 12; (4) an angle of repose of toner is measured; the angle of repose is identified as an angle between an inclined surface of a cone-shaped piling layer of fallen toner and an upper surface of the circular plate 13.

Referring to Table 4, if the angle of repose of toner is greater than or equal to 25 degrees, the undesirable lateral strip on the image and the variation in the surface voltage of the photosensitive drum 1 do not cause any problems practically.

(1) a toner cartridge is filled with toner in state of natural filling; (2) a square-shaped metal plate as a spatula is inserted into a toner layer horizontally; (3) the toner cartridge is moved downward; (4) a first incline angle (θ1) of toner remaining on the spatula is measured, the first incline angle is identified as an angle between an inclined surface of a toner layer and a surface of the spatula; (5) the spatula with the toner layer is shocked by constant force, a second incline angle (θ2) of toner remaining on the spatula is measured, the second incline angle is identified as an angle between an inclined surface of a toner layer and a surface of the spatula; and (6) the angle of spatula is calculated in the following formula, angle of spatula=(θ1+θ2)/2.

Referring to Table 5, if the angle of spatula of toner is equal to or more than 25 degrees, the undesirable lateral strip on the image and the variation in the surface voltage of the photosensitive drum 1 do not cause any problems practically.

As a property value of toner with respect to cohesiveness, the angle of repose, and the angle of spatula is specified more than certain values, the undesirable lateral strip is reduced and uniformity of charge distribution is improved in the contact charge member. The stable image is maintained in a long period. The reason for this is that attachment force of toner to the photosensitive drum is reduced.

TABLE 4

| Angle of Repose | No. of delivered paper | 0 | 10000 | 20000 | 30000 | 40000 | 50000 | 60000 |
|---|---|---|---|---|---|---|---|---|
| 5° | Lateral strip | 0 | 0 | Δ | X | X | X | X |
| | Surface Voltage (v) | −900 | −890 | −870 | −850 | −830 | −820 | −800 |
| 15° | Lateral strip | 0 | 0 | 0 | Δ | Δ | X | X |
| | Surface Voltage (v) | −900 | −900 | −890 | −880 | −860 | −840 | −830 |
| 25° | Lateral strip | 0 | 0 | 0 | 0 | 0 | 0 | Δ |
| | Surface Voltage (v) | −900 | −900 | −900 | −900 | −900 | −890 | −890 |
| 35° | Lateral Strip | 0 | 0 | 0 | 0 | 0 | 0 | 0 |
| | Surface Voltage (v) | −900 | −900 | −900 | −900 | −900 | −900 | −900 |

In Table 5, results of an angle of spatula of toner with respect to the number of delivered paper measured by the following procedure, variation in the surface voltage of the photosensitive drum 1 and presence/absence of the undesirable lateral strip on the image, are shown.

The measuring procedure for the angle of spatula includes the following steps (1)–(6):

TABLE 5

| Angle of Spatula | No. of delivered paper | 0 | 10000 | 20000 | 30000 | 40000 | 50000 | 60000 |
|---|---|---|---|---|---|---|---|---|
| 5° | Lateral strip | 0 | X | X | — | — | — | — |
| | Surface Voltage | −900 | −840 | −820 | — | — | — | — |
| 15° | Lateral strip | 0 | 0 | 0 | X | X | — | — |
| | Surface Voltage | −900 | −900 | −880 | −860 | −840 | — | — |
| 25° | Lateral strip | 0 | 0 | 0 | 0 | 0 | 0 | 0 |
| | Surface Voltage | −900 | −900 | −900 | −900 | −890 | −890 | −885 |
| 35° | Lateral strip | 0 | 0 | 0 | 0 | 0 | 0 | 0 |
| | Surface Voltage | −900 | −900 | −900 | −900 | −900 | −895 | −890 |
| 45° | Lateral strip | 0 | 0 | 0 | 0 | 0 | 0 | 0 |
| | Surface Voltage | −900 | −900 | −900 | −900 | −900 | −900 | −890 |

In the above mentioned embodiment of FIG. 1, the charge roller is used as the contact charge member. However, a plate-shaped, belt-shaped or brush-shaped charge member can be applied to the present invention.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

a photosensitive body;

a charge member held in contact with said photosensitive body and for charging said photosensitive body by applying a voltage thereto;

an exposure device for exposing a surface of said photosensitive body charged by said charge member and for forming an electrostatic latent image on said photosensitive body; and a developing device for attaching toner to said electrostatic latent image on said photosensitive body and for visualizing said electrostatic latent image, wherein a particle diameter of fine powder of said toner used in said developing device is equal to or less than 3 μm, and a containing rate of said fine powder is equal to or less than 5%.

2. An image forming apparatus comprising:

a photosensitive body;

a charge member held in contact with said photosensitive body and for charging said photosensitive body by applying a voltage thereto;

an exposure device for exposing a surface of said photosensitive body charged by said charge member and for forming an electrostatic latent image on said photosensitive body; and a developing device for attaching toner to said electrostatic latent image on said photosensitive body and for visualizing said electrostatic latent image, wherein said toner used in said developing device is manufactured by a method of polymerization, and wherein an angle of spatula of said toner used in said developing device is greater than or equal to 25 degrees.

3. An image forming apparatus comprising:

a photosensitive body;

a charge member held in contact with said photosensitive body and for charging said photosensitive body by applying a voltage thereto;

an exposure device for exposing a surface of said photosensitive body charged by said charge member and for forming an electrostatic latent image on said photosensitive body; and a developing device for attaching toner to said electrostatic latent image on said photosensitive body and for visualizing said electrostatic latent image, wherein a cohesiveness of said toner used in said developing device is greater than or equal to 9%.

4. An image forming apparatus comprising:

a photosensitive body;

a charge member held in contact with said photosensitive body and for charging said photosensitive body by applying a voltage thereto;

an exposure device for exposing a surface of said photosensitive body charged by said charge member and for forming an electrostatic latent image on said photosensitive body; and a developing device for attaching toner to said electrostatic latent image on said photosensitive body and for visualizing said electrostatic latent image, wherein an angle of spatula of said toner used in said developing device is greater than or equal to 25 degrees.

* * * * *